US005573386A

United States Patent [19]

Schmitt et al.

[11] Patent Number: 5,573,386

[45] Date of Patent: Nov. 12, 1996

[54] RECIPROCATING PISTON PUMP

[75] Inventors: Edgar Schmitt, Vaihingen; Barbara Schwind-Grellmann, Wiernsheim; Harald Ott, Ditzingen, all of Germany

[73] Assignee: Robert Bosch GmbH, Stuttgart, Germany

[21] Appl. No.: 374,366

[22] Filed: Jan. 18, 1995

[30] Foreign Application Priority Data

Jan. 29, 1994 [DE] Germany ..... 44 02 650.1
Aug. 4, 1994 [DE] Germany ..... 44 27 612.5

[51] Int. Cl.[6] ..... F04B 1/02; F04B 53/14

[52] U.S. Cl. ..... 417/521; 417/273; 303/116.4; 92/148

[58] Field of Search ..... 417/271, 273, 417/521, 538; 92/72, 73, 151, 148; 91/491; 303/116.4

[56] References Cited

U.S. PATENT DOCUMENTS

| | | | |
|---|---|---|---|
| 2,271,570 | 2/1942 | Pardee . | |
| 2,309,551 | 1/1943 | Trapp et al. | 417/273 |
| 3,259,074 | 7/1966 | Erdmann | 417/273 |
| 4,977,606 | 12/1990 | Budecker . | |
| 5,213,482 | 5/1993 | Reinartz et al. | 417/273 |

FOREIGN PATENT DOCUMENTS

| | | |
|---|---|---|
| 989658 | 9/1992 | France . |
| 4102364 | 7/1964 | Germany . |
| 4102384 | 7/1972 | Germany . |
| 2243138 | 3/1974 | Germany . |
| 2102761 | 4/1974 | Germany . |
| 3722988 | 1/1989 | Germany . |

*Primary Examiner*—Timothy S. Thorpe
*Assistant Examiner*—William Wicker
*Attorney, Agent, or Firm*—Edwin E. Greigg; Ronald E. Greigg

[57] ABSTRACT

A reciprocating piston pump having a housing, pistons disposed opposite one another in the housing, an eccentric between the pistons, annular grooves that fit around the piston necks machined into piston ends oriented toward the eccentric, and a U-shaped hoop spring curved radially outside the eccentric in the circumferential direction thereof. The hoop spring includes forklike hoop spring ends which engage the annular grooves and press the piston ends toward the eccentric. In the circumferential direction of the substantially U-shaped hoop spring, a continuation is formed on the hoop spring and together with a stop disk aligned transversely to the eccentric shaft, forms a device that limits the pivotability of the hoop spring about the piston necks. The reciprocating piston pump is usable for instance in hydraulic motor vehicle brake systems and in other hydraulic equipment.

20 Claims, 6 Drawing Sheets

RECIPROCATING PISTON PUMP

BACKGROUND OF THE INVENTION

The invention is based on a reciprocating piston pump as set forth hereinafter.

German Offenlegungsschrift 22 43 138 discloses a reciprocating piston pump having a housing with two pistons disposed in the housing so as to be displaceable in opposite directions, having an eccentric between the pistons, with transverse bores disposed in the ends of the pistons pointing toward the eccentric, and with an essentially semicircular hoop spring made of spring steel wire, whose ends engage the transverse bores of the piston ends and press these ends of the piston against the eccentric. The hoop spring can be made economically, but it is very difficult to keep the transverse bores aligned essentially parallel to one another, and to keep them aligned in such a way that the ends of the hoop springs can be inserted. This may be made even more difficult because an eccentric chamber located in the housing is open on only one side, for instance. Moreover, the hoop spring ends must be secured against coming out of the transverse bores; this could be done for instance by bending the ends after they have been inserted through the transverse bores. To limit pendulum motions of the hoop spring about the longitudinal axes of the piston, a groove is machined into the housing beginning at the eccentric chamber, and the hoop spring enters this groove. If a reciprocating piston pump of this kind is supposed to be light in weight and its housing is therefore made of aluminum, then it cannot be precluded that aluminum will be worn away from the housing, thereby soiling the reciprocating piston pump and possibly causing disruptions in operation over the course of time.

German Patent Reference DE 41 02 364 A1 discloses a further reciprocating piston pump with a housing that has an eccentric chamber, with pistons disposed facing one another relative to an eccentric, and with annular grooves disposed on the ends of the pistons pointing toward the eccentric, which grooves are engaged by the forklike ends of a hoop spring that is curved around the axis of the eccentric. This reference does not disclose how pendulum motions of the hoop spring about the longitudinal axis of the pistons could be limited or how contact of the hoop spring with the housing could be avoided.

OBJECT AND SUMMARY OF THE INVENTION

The reciprocating piston pump according to the invention has an advantage that after an easy assembly of the hoop spring ends on the pistons and after the installation of the stop disk in the housing, pendulum motions of the hoop spring about the longitudinal axes of the pistons are limited in a low-wear fashion.

Advantageous further features of and improvements to the reciprocating piston pump disclosed herein are attainable as set forth hereinafter. The device includes a stop disk that is precombined with the eccentric shaft and together with it can be installed in the housing, so as to save assembly time on the assembly line. The device can be manufactured economically and functions with low wear. The pump has an advantage that while a structurally chosen axial spacing of the work side of the stop disk from the longitudinal axes from the pistons is preserved, the force or elasticity of the hoop spring is selectable by varying the width of a metal region of the hoop spring. As a result, it is for instance possible to depart from a preplanned spring sheet-metal thickness for producing the hoop spring, and to use a spring sheet metal with a thickness of a kind that is rapidly procurable on the market or from the rolling mill.

In assembly of the reciprocating piston pump, the hoop spring can be introduced with the recesses leading into an eccentric chamber of the reciprocating piston pump, and after the creation of the snap connection to the piston necks can be pivotably aligned about the piston necks for the sake of then inserting the eccentric between the pistons. The piston pump has an advantage that the recesses can be made long enough so as to achieve the required elasticities at the ends of the hoop spring in order to produce the snap connections.

Another advantage is that the hoop spring can be introduced into the eccentric chamber of the reciprocating piston pump with its recesses leading, with an alignment that for instance is essentially equivalent to pivoting alignments of the kind that occur during operation of the reciprocating piston pump. This makes automatic installation of the hoop spring easier. Immediately after the hoop spring has been combined with the pistons, the eccentric can be installed together with the stop disk; the stop disk completes the pivoting alignment as applicable. Still another advantage is that despite unavoidable errors in the shape of the hoop spring, a uniform transfer of spring force to the applicable piston end is possible. The result is that wear is distributed and hence made more uniform, and hence the service life of the piston pump is increased.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
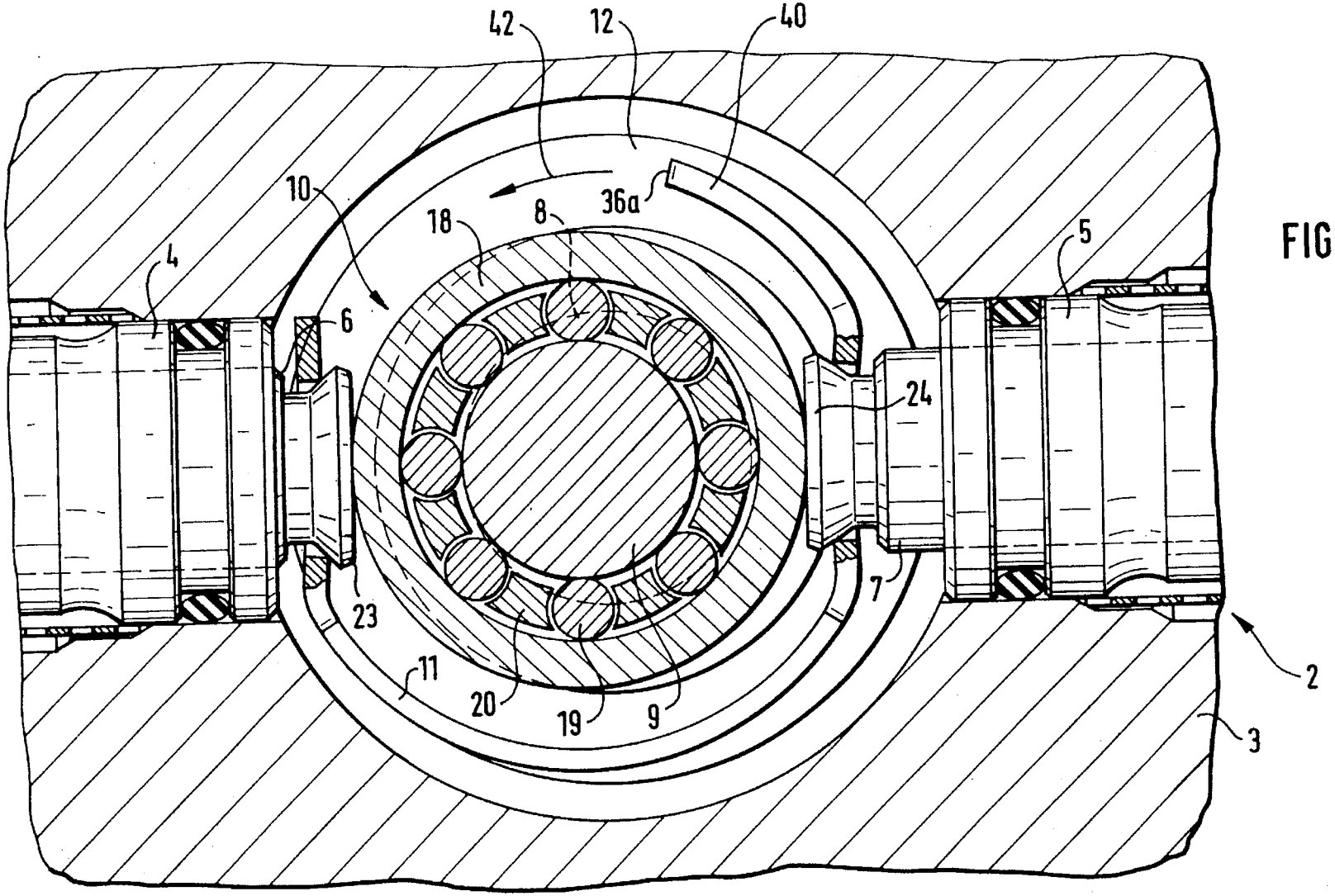
FIG. 1 is a section through a first exemplary embodiment of the reciprocating piston pump according to the invention, transversely to the axis of an eccentric shaft in the region of an eccentric.
Figure 2:
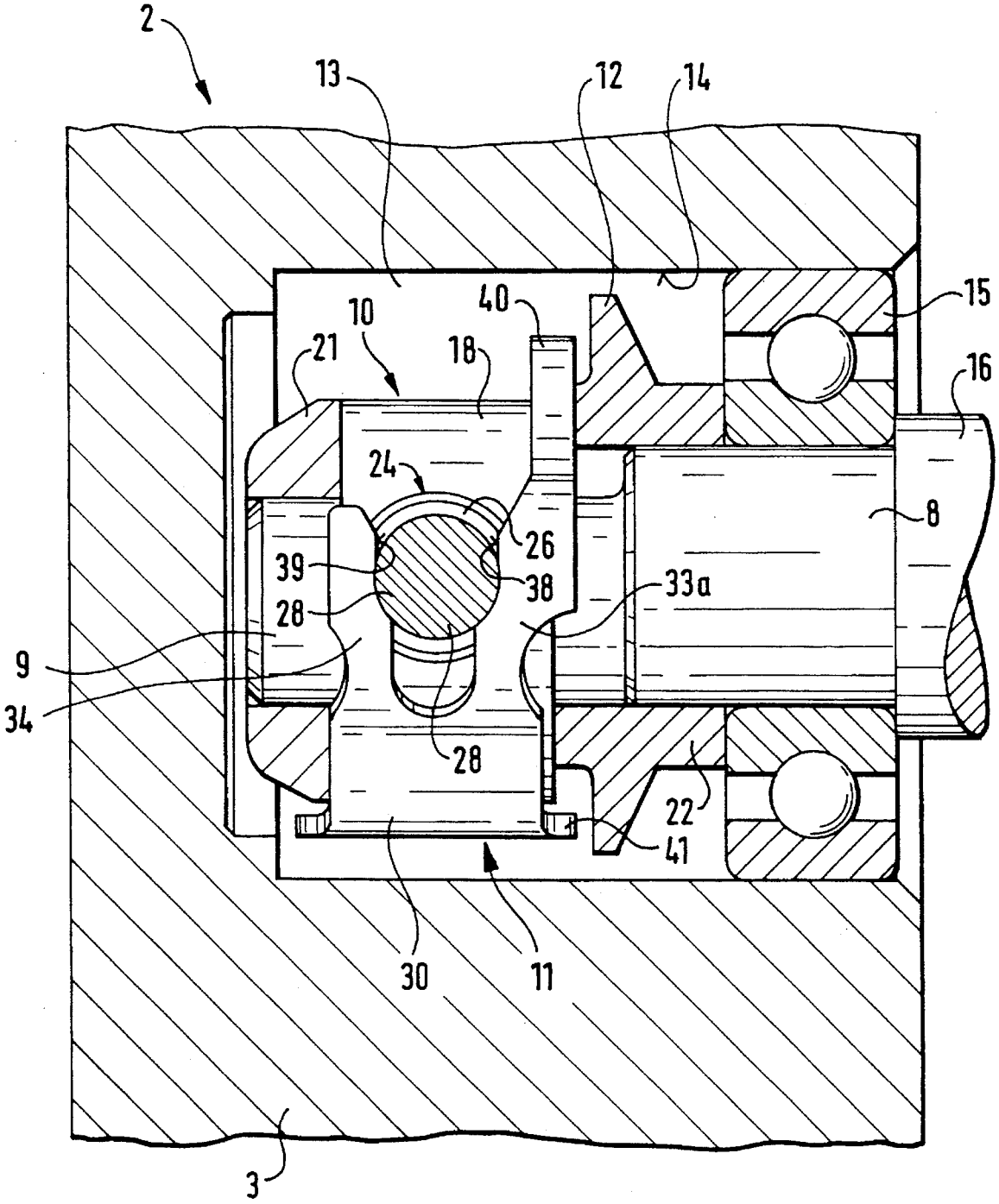
FIG. 2 is a section taken in stages transversely to a piston of the reciprocating piston pump of the invention of FIG. 1 and parallel to the axis of the eccentric shaft.
Figure 3:
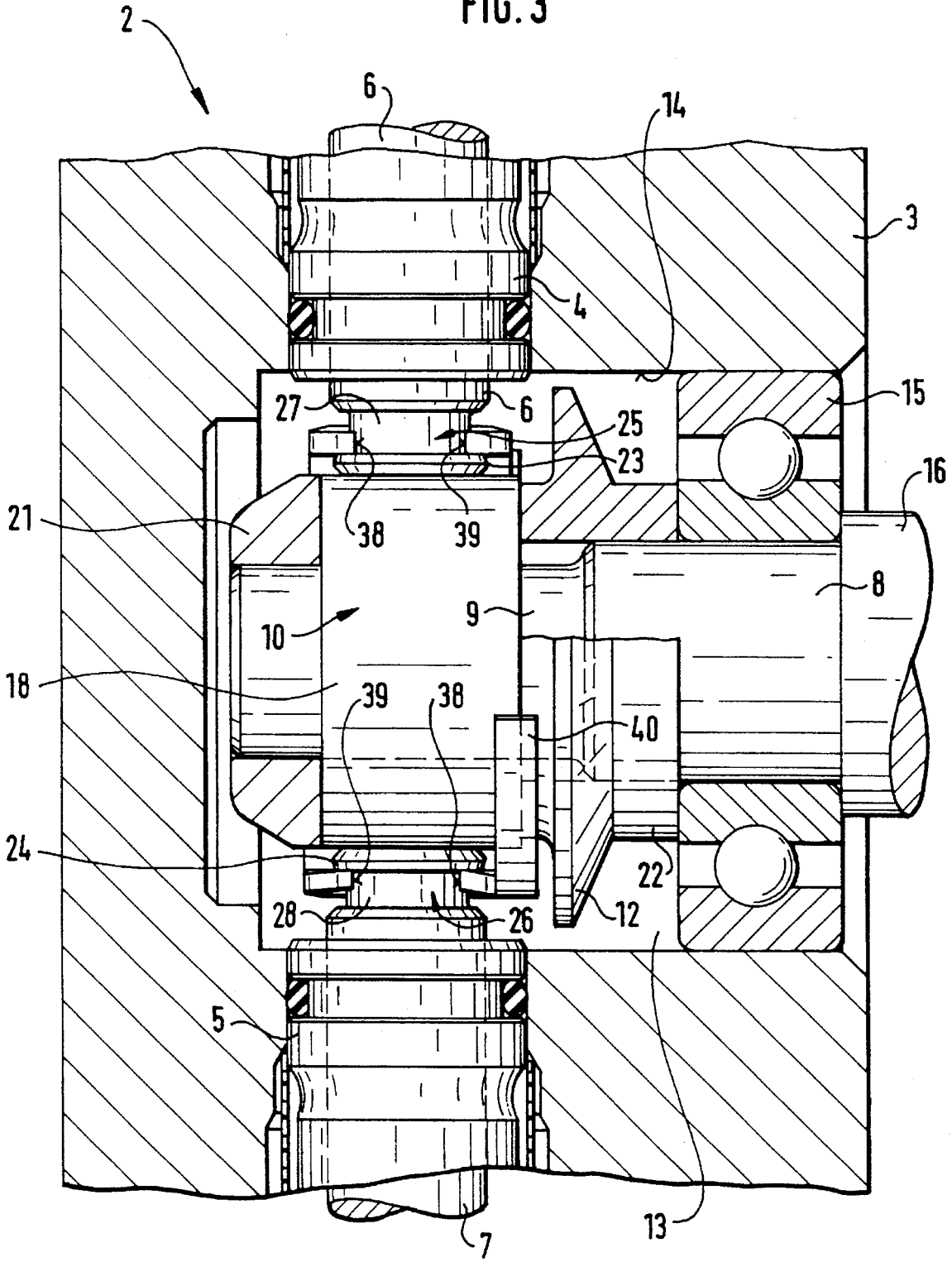
FIG. 3 is a section through the reciprocating piston pump of the invention of FIG. 1, in a reference plane located in the axes of the piston and of the eccentric shaft.

The reciprocating piston pump 2 of FIGS. 1–3 has a housing 3, two cylinders 4, 5, two pistons 6, 7, an eccentric 9 beginning at an end of a shaft 8, a roller bearing 10 surrounding the eccentric 9, an essentially U-shaped hoop spring 11, and a stop disk 12. Disposed inside the housing 3 is an eccentric chamber 13, which is formed by means of a bore 14. By way of example, the bore 14 receives a roller bearing 15, which surrounds a portion of the length of the shaft 8 and rotatably supports the shaft 8. Outside the housing 3, the roller bearing 15 is adjoined by a further portion 16 of the shaft length, which leads to a second bearing, not shown. The shaft length portion 16 is by way of example on the one hand a component of the shaft 8 overall, and preferably at the same time is a component of a motor shaft of an electric motor, not shown, in a manner known for instance from anti-lock devices for motor vehicles, which are sold in great numbers; in this case, the term "anti-lock devices" means the so-called feedback type. Next to the roller bearing 15, the shaft 8 is adjoined by the eccentric 9; the shaft 8 and eccentric 9 are an integral embodiment, for instance by reducing the cross section within the projection of the shaft 8. As can already be deduced, the eccentric 9 protrudes into the eccentric chamber 13. The roller bearing 10 for instance comprises an outer ring 18, the eccentric 9, which is hardened, and between them roller bodies 19, which are guided spaced apart, for instance by means of a guide cage 20. The roller bodies 19 are preferably embodied as so-called bearing needles. An axial stop ring 21 is pressed onto the eccentric 9 next to the roller bearing 10 and assures that both the outer ring 18 and the roller bodies 19 will remain in a desired axial alignment relative to the eccentric 9. Between the roller bearing 10 and the roller bearing 15 of the shaft 8 there is a hub 22, likewise acting as an axial stop ring, from which the stop disk 12 extends radially; the hub is pressed onto the shaft 8 and thus fixed in a manner free of relative rotation with respect to that shaft. As best seen from FIG. 3, the cylinders 4 and 5 are aligned coaxially and transversely to the shaft 8 and are installed in the housing 3 in a sealed fashion. Both cylinders 4 and 5 end at the eccentric chamber 13. The pistons 6 and 7 are disposed in them in a sealed and displaceable fashion. Aligned with the eccentric 9, or the outer ring 18 rotatably supported about it, the pistons 6 and 7 have piston ends 23 and 24. Next to the piston ends or bases 23 and 24, annular grooves 25 and 26 are machined into the pistons 6 and 7, so that piston necks 27 and 28, respectively, for instance of cylindrical shape, remain between the pistons 6 and 7 and the piston ends 23 and 24, respectively.

Figure 4:
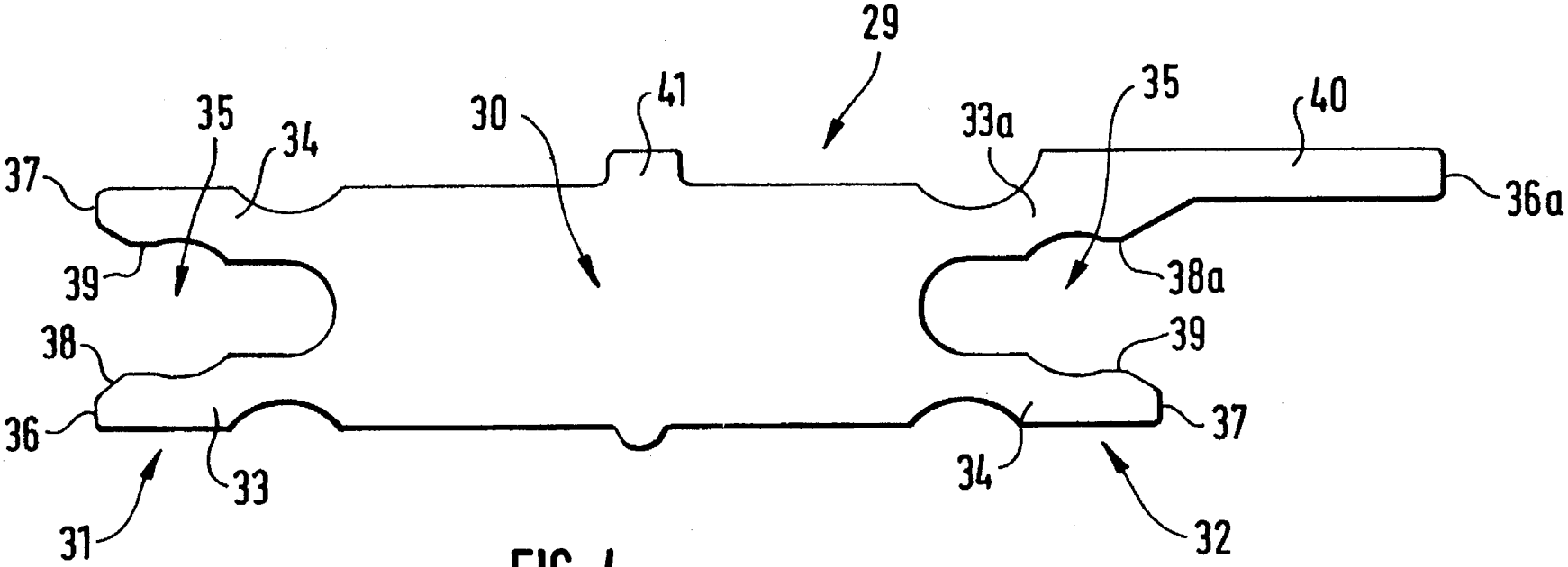
FIG. 4 shows a blank for one component according to the invention of this reciprocating piston pump.

The hoop spring 11 is a substantially striplike cut piece 29 shown in FIG. 4. The cut piece 29 comprises a spring material suitable for making leaf springs, for instance. The spring material may for example be a heat-treatable type of steel.

The cut piece 29 has a middle region 30, which is adjoined by a first hoop spring end 31 and opposite it a second hoop spring end 32. The first hoop spring end 31 is forklike and for that purpose has two resiliently embodied arms 33, 34 with a recess 35 located between them that begins at the middle region 30 and as a result the resilient arms 33 and 34 are formed. In the region of the free ends 36 and 37 of the resilient arms 33 and 34, respectively, the arms 33 and 34 have protrusions 38 and 39 aimed at one another. On the cut piece 29, a distance remains between the two protrusions 38 and 39 that is less than the diameter of the neck 27 of the piston 6 associated with it later. Adjoining the protrusions 38 and 39, the recess is shaped in such a way that it later surrounds the piston neck 27, with or without play. In the same way, the second hoop spring end 32 has a resilient arm 34 with a protrusion 39 and a free end 37. A further resilient arm **33*a* of the second hoop spring end 32 differs from the resilient arm 33 of the hoop spring end 31 in that, beginning at a protrusion 38*a* that is opposite the protrusion 39 described above, a continuation 40 is formed on in the extension of the resilient arm 33*a*. The continuation 40 has a free end 36*a*, which is spaced apart by a greater distance from the associated protrusion 38*a* than that by which the free end 37 of the second hoop spring end 32 is spaced apart from its protrusion 39. If the term "fork-like hoop spring ends" is used, then one can imagine the continuation 40** to be a lengthened tine of the fork.

Opposite the protrusion **38*a* of the resilient arm 33*a*, the continuation 40 is rectilinear, for instance, and parallel to an imaginary connecting line between the two recesses 35. In the present example, this imaginary boundary line is located outside the middle region 30 of the cut part 29. In this case, a further continuation 41 begins at the middle region 30 crosswise to the imaginary connecting line between the recesses 35, and ends in the extension of an edge of the first continuation 40** mentioned.

The cut part 29 described is bent in a curve, producing the hoop spring 11. This bending may be imagined in such a way, beginning at the position of the cut part 29 shown in FIG. 4, that the first hoop spring end 31 and the second hoop spring end 32 are bent upward out of the plane of the drawing, with the middle region 30 being given a concave curvature between the upward-protruding hoop spring ends 31 and 32. The first continuation 40 is also bent in the same direction of curvature of the middle region 30. The hoop spring 11 in the curved state described can be seen in FIG. 3. There the continuation 40 is easily visible above the outer ring 18, next to the end 24 of the piston 7. Also readily visible in FIG. 3 is the fact that the protrusions 38 and 39 reach around the neck 28 of the piston 7. In the same way, the protrusions 38, 39 of the first hoop spring end 31 reach around the neck 27 of the piston 6. Finally, FIG. 1 shows the hoop spring 11 and its continuation 40 in a drawing plane folded over 90°, looking to the eccentric 9 and the shaft 8 located behind it and therefore shown in dashed lines. Finally, FIG. 2 shows the piston neck 28 in cross section as well as the resilient arms **33*a* and 34, showing how they border on the piston neck 28 and together with their protrusions 38 and 39 receive the piston neck 28** between them.

When the reciprocating piston pump of the invention is put together, first the cylinder 4 and 5 with their pistons 6 and 7 are installed in the housing 3. Then, through the bore 14, the hoop spring 11 with its free ends 36, **36*a* and 37 essentially leading is moved and pressed toward the piston necks 27, 28; as a result, because of the protrusions 38, 38*a* and 39, the resilient arms 33, 33*a* and 34 are moved elastically apart, so that the protrusions 38 and 39 slide over the piston necks 27 and 28 and can snap together behind the middles of these necks. As a result, the piston necks 27 and 28 are locked in detent fashion into the hoop spring ends 32 and 33. The hoop spring 11 is now pivoted into the alignment especially clearly shown in FIGS. 2 and 3. After that, the shaft 8 can be thrust between the piston ends 23 and 24 with the stop ring 21, which is conically embodied for this purpose, leading; this opens the hoop spring 11 elastically wider. Upon further motion of the shaft 8, the outer ring 18 finally comes to be located between the piston ends 23 and 24, and the roller bearing 15 also plunges all the way into the bore 14. As can be seen from FIGS. 2 and 3, the stop disk 12 then takes its place adjoining the two continuations 40 and 41. In FIG. 2, there is an equal-length spacing shown between each of these extensions 40 and 41 and the stop disk 12**, but this spacing is not preserved during operation of the reciprocating piston pump of the invention.

For operation of the reciprocating piston pump 2 according to the invention, the eccentric 9 is driven via the shaft 8, by means of the drive motor, not shown, preferably in a rotational direction indicated in FIG. 1 by the arrow 42 shown on the stop disk 12. In other words, during the operation of the piston pump 2, a reference point located on the stop disk 12 moves from the piston 7 away toward the free end 36*a* of the first continuation 40, and from there finally on to the opposite piston 6. This has the advantage that whenever the free end 36*a* of the continuation 40, for whatever reason, enters into frictional contact with the encompassing stop disk 12, an impetus is imparted to the free end 36*a*, which proceeds in the manner of a pivoting of the continuation 40 about the piston necks 27 and 28 away from the stop disk 12. The opposite direction of rotation would have the result that if there were frictional contact between the free end 36*a* and the stop disk 12, the frictional contact could be reinforced. To prevent the free end 36*a* from being capable of moving unintentionally far away from the stop disk 12, the second continuation 41 already described is provided which limits a pivoting motion of the hoop spring 11 about the piston necks 27 and 28 by striking the stop disk 12.

From FIG. 2 in the above description, it is accordingly clear that pivoting or pendulum motions of the hoop spring 11 about the piston necks 27 and 28 are limited in such a way that the hoop spring 11 gains no contact with the housing 3. Therefore in a manner according to the invention, the removal of material comprising the housing 3 by the hoop spring as a consequence of its periodic motions is averted. The importance of this provision of the invention is emphasized even more by the fact that because eccentric contacts between the piston bases 23 and 24 and the outer ring 18, disposed rotatably about the eccentric 9, cannot be precluded, rotations of the pistons 6 and 7 and hence of their necks 27 and 28 as well are possible. It is a matter of chance what extent the rotations might assume and to what extent pivoting motions of the hoop spring 31 might then increase as a result of frictional engagement between piston necks 27 and 28 and the piston bases 23 and 24 and the hoop spring ends 31 and 32, respectively, if there were no limitation of the pivoting angle. Although for this reasons alternating frictional contact between the first continuation 40 and the stop disk 12 and between the second continuation 41 and this stop disk 12 is unavoidable, nevertheless because the hoop spring is made of a spring material such as steel and the stop disk 12 is likewise of steel, which for example is hardened, any wear is so slight that premature failure of the reciprocating piston pump 2 is averted.

Figure 5:
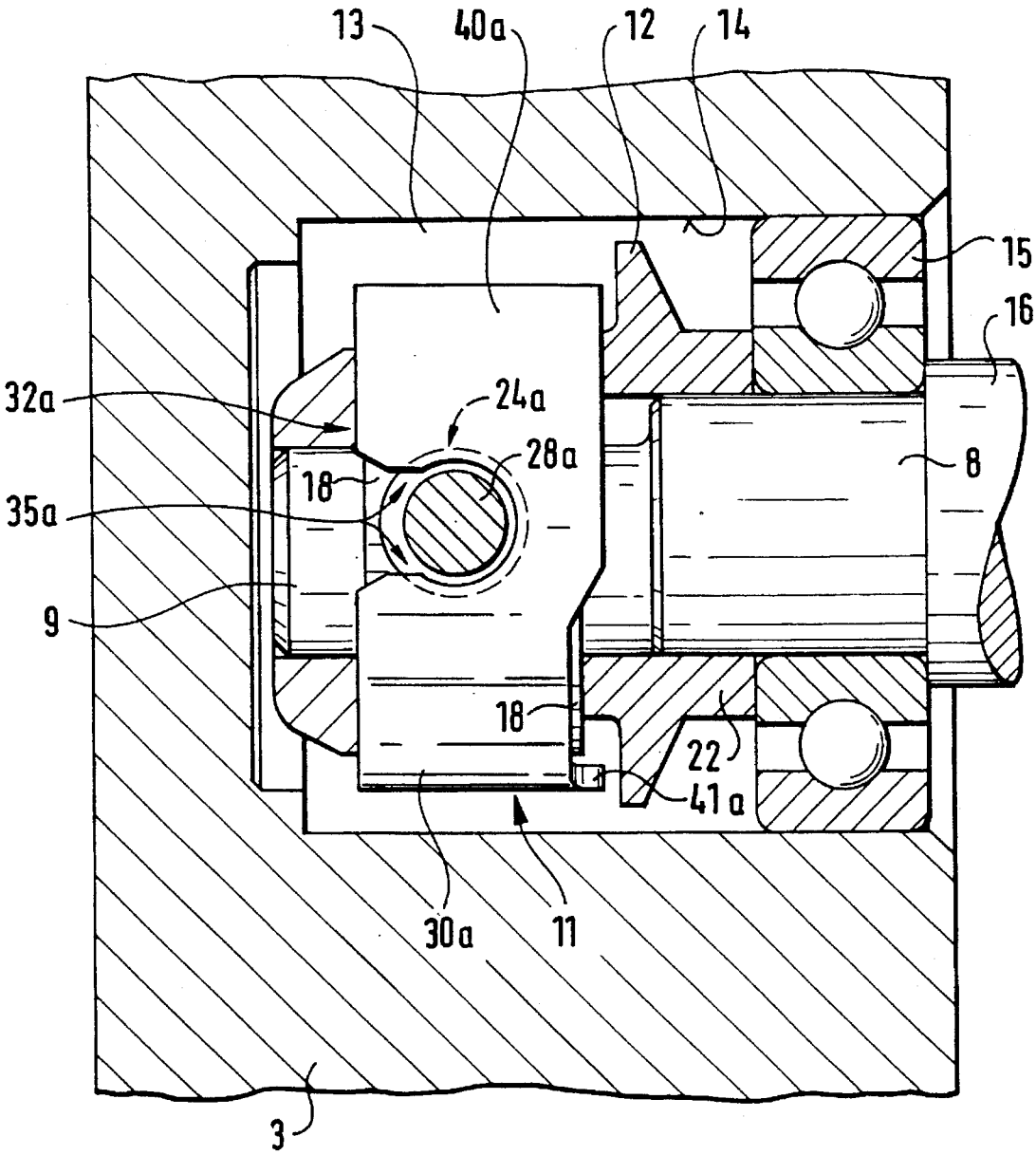
FIG. 5 is a section through a second exemplary embodiment of the reciprocating piston pump of the invention.
Figure 7:
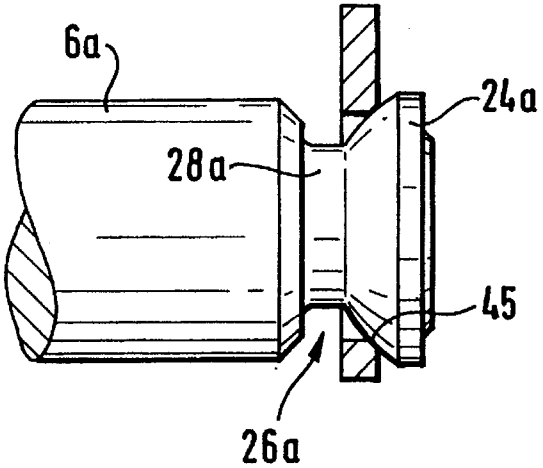
FIG. 7 shows a further component for the second exemplary embodiment.
Figure 6:
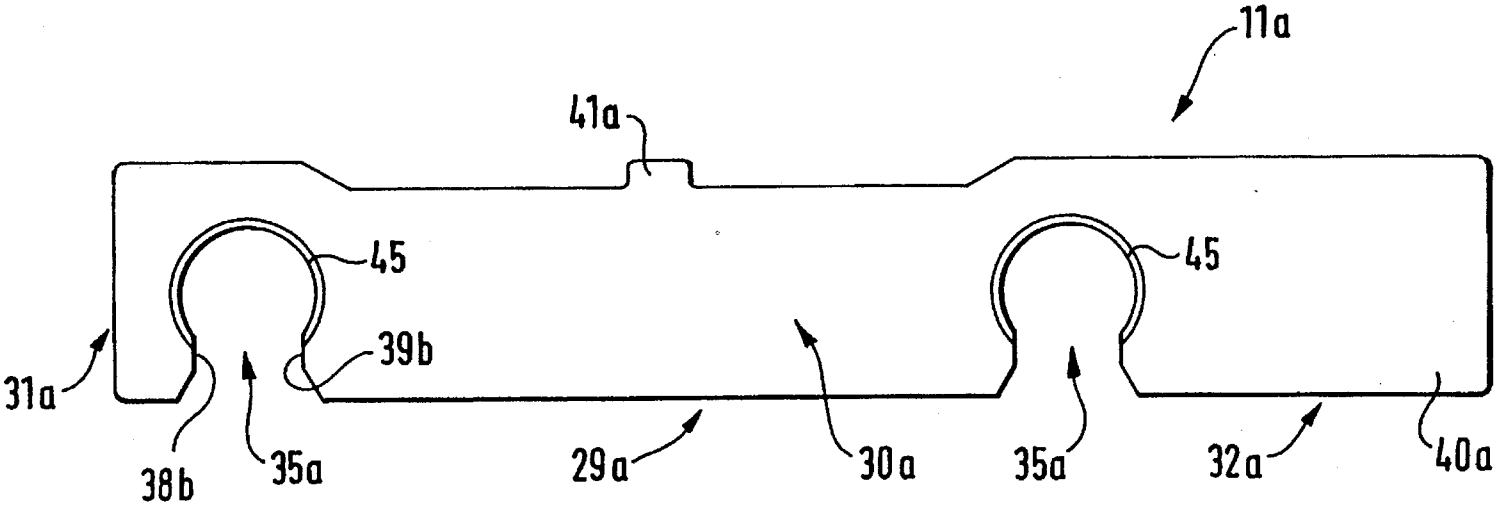
FIG. 6 shows a blank for a component according to the invention of the second exemplary embodiment.

In a distinction from the hoop spring 11 from the first exemplary embodiment, in FIGS. 5 and 6 recesses 35*a* and 36*a* of the second exemplary embodiment of the hoop spring 11*a* are aligned transversely to the course of curvature of the hoop spring, or to the main dimension of the cut part 29*a*. Because of this transverse alignment, a wider continuation 40*a* can extend in the circumferential direction beginning at one hoop spring end 32*a*. A middle region 30*a* of the second exemplary embodiment may likewise have a continuation 41*a*, which within the reciprocating piston pump points toward the stop disk 12, which can be the same as that of the first exemplary embodiment.

In the second exemplary embodiment, protrusions 38*b* and 39*b* are aimed toward one another and defining the recesses 35*a* are such a distance from one another that by way of example a piston neck 28*a* can be moved between the protrusions 38*b* and 39*b* without being forced. It is accordingly not necessary to embody the hoop spring ends 31*a* and 32*a* especially elastically. Bordering on the recesses 35*a* are contact faces 45 of circular arclike outline, which by way of example are inclined by 45° relative to the reference plane of the cut part 29*a*. The enclosed curve may extend over an angle of essentially 270°, for example.

Formed onto the contact faces 45, which in this way are formed as hollow-conical, are piston ends 24*a*, shaped in the manner of a spherical layer, on the respective piston 6*a* beginning at its piston neck 28*a*.

When the reciprocating piston pump is assembled, the hoop spring 11*a* can be introduced with the open regions of its recesses 35*a* leading, and essentially parallel to the bore 14 of the eccentric chamber 13, as a result of which the recesses 35*a* finally receive the piston necks 6*a*. During this introduction, the hoop spring 11*a* can therefore have a pivoting alignment, which essentially matches the pivoting alignment shown in FIG. 5. In the next work step, an axial stop ring 21 can already be inserted, and following it an eccentric 9 together with an outer ring 18 can be inserted between the pistons 6*a*. In the process, the stop spring 12 then moves closer to the hoop spring 11*a* as well and if necessary can align it completely. A separate work step of "pivoting the spring hoop by hand or by assembly robot", which is necessary in the first exemplary embodiment, is not needed for the second exemplary embodiment.

During the operation of the reciprocating piston pump, the conical contact faces 45 and the spherically formed piston ends 24*a* act in the manner of ball and socket joints.

It should further be noted that the alignments of the recesses 35 of the first exemplary embodiment may also be adopted for the second exemplary embodiment, and vice versa. Selectively, however, the piston 6*a* of the second exemplary embodiment and the associated shape of the recesses 35*a* may be adopted for the first exemplary embodiment. In other words, by means of the individual characteristics shown, more than the two exemplary embodiment shown can be achieved.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A reciprocating piston pump having a housing, oppositely disposed displaceable pistons operative in the housing, an eccentric between the pistons, a shaft that carries and drives the eccentric, annular grooves machined into piston ends directed toward the eccentric which define piston necks, a hoop spring which is curved in a circumferential direction of the eccentric, said hoop spring has spring ends with recesses that engage the annular grooves of said pistons and press the piston ends toward the eccentric, said hoop spring includes on a side toward the eccentric shaft, a substantially striplike continuation (40, 40*a*) that forms one hoop spring end which continuation is located juxtaposed an associated stop disk (12) aligned transversely to the shaft (8), said stop disk is made of low-wear material and acts as a pivoting angle limiter for the hoop spring (11, 11*a*).

2. A reciprocating piston pump as defined by claim 1, in which protrusions (38, 39) directed toward one another are present in the recesses (35) and partially reach around the piston necks (27, 28) in the manner of snap connections.

3. A reciprocating piston pump as defined by claim 1, in which the recesses (35, 35*a*) are aligned extending in the circumferential direction of the hoop spring (11*a*).

4. A reciprocating piston pump as defined by claim 1, in which the recesses (35*a*) are disposed transversely to the circumferential direction of the hoop spring (11, 11*a*).

5. A reciprocating piston pump as defined by claim 1, in which beginning at piston necks (28*a*), the piston ends (24*a*) are shaped to have spherical surfaces, and that in alignment with the piston ends (24*a*), the recesses (35*a*) have contact faces extending around a respective axis of said spherical surfaces in a shape of a circular arc.

6. A reciprocating piston pump as defined by claim 1, in which a second continuation (41) begins at a middle region (30) of said hoop spring located between the hoop spring ends (31, 32) and embodied essentially in the form of a strip, beginning on a side oriented toward the stop disk (12) transversely to the strip, and that both continuations (40, 41) end at a first reference plane, which extends parallel to a second reference plane extending through the recesses (35) of the hoop spring ends (31, 32).

7. A reciprocating piston pump as defined by claim 6, in which protrusions (38, 39) directed toward one another are present in the recesses (35) and partially reach around the piston necks (27, 28) in the manner of snap connections.

8. A reciprocating piston pump as defined by claim 1, in which the stop disk (12) is embodied as a sintered component made of steel which has been hardened.

9. A reciprocating piston pump as defined by claim 8, in which a second continuation (41) begins at a middle region (30) of said hoop spring located between the hoop spring ends (31, 32) and embodied essentially in the form of a strip, beginning on a side oriented toward the stop disk (12) transversely to the strip, and that both continuations (40, 41) end at a first reference plane, which extends parallel to a second reference plane extending through the recesses (35) of the hoop spring ends (31, 32).

10. A reciprocating piston pump as defined by claim 8, in which protrusions (38, 39) directed toward one another are present in the recesses (35) and partially reach around the piston necks (27, 28) in the manner of snap connections.

11. A reciprocating piston pump as defined by claim 3, in which the recesses (**35, 35*a*) are aligned extending in the circumferential direction of the hoop spring (11*a***).

12. A reciprocating piston pump as defined by claim 8, in which the recesses (**35*a*) are disposed transversely to the circumferential direction of the hoop spring (11, 11*a***).

13. A reciprocating piston pump as defined by claim 1, in which the stop disk (12) is provided with a hub (22), and that the hub (22) is joined to the shaft (8) in a manner secure against relative rotation.

14. A reciprocating piston pump as defined by claim 13, in which a second continuation (41) begins at a middle region (30) of said hoop spring located between the hoop spring ends (31, 32) and embodied essentially in the form of a strip, beginning on a side oriented toward the stop disk (12) transversely to the strip, and that both continuations (40, 41) end at a first reference plane, which extends parallel to a second reference plane extending through the recesses (35) of the hoop spring ends (31, 32).

15. A reciprocating piston pump as defined by claim 13, in which protrusions (38, 39) directed toward one another are present in the recesses (35) and partially reach around the piston necks (27, 28) in the manner of snap connections.

16. A reciprocating piston pump as defined by claim 13, in which the recesses (**35, 35*a*) are aligned extending in the circumferential direction of the hoop spring (11*a***).

17. A reciprocating piston pump as defined by claim 13, in which the recesses (**35*a*) are disposed transversely to the circumferential direction of the hoop spring (11, 11*a***).

18. A reciprocating piston pump as defined by claim 13, in which beginning at piston necks (**28*a*), the piston ends (24*a*) are shaped to have spherical surfaces, and that in alignment with the piston ends (24*a*), the recesses (35*a***) have contact faces extending around a respective axis of said spherical surfaces in a shape of a circular arc.

19. A reciprocating piston pump as defined by claim 13, in which the stop disk (12) is embodied as a sintered component made of steel which has been hardened.

20. A reciprocating piston pump as defined by claim 19, in which a second continuation (41) begins at a middle region (30) of said hoop spring located between the hoop spring ends (31, 32) and embodied essentially in the form of a strip, beginning on a side oriented toward the stop disk (12) transversely to the strip, and that both continuations (40, 41) end at a first reference plane, which extends parallel to a second reference plane extending through the recesses (35) of the hoop spring ends (31, 32).

* * * * *